United States Patent [19]

Force

[11] 4,450,629

[45] May 29, 1984

[54] OFFSET PRESS ATTACHMENT

[76] Inventor: Shirley M. Force, 1801 Yost Rd., Norristown, Pa. 19401

[21] Appl. No.: 447,285

[22] Filed: Dec. 6, 1982

[51] Int. Cl.[3] ..... B41B 1/00

[52] U.S. Cl. ..... 33/184.5; 33/181 R

[58] Field of Search ..... 33/184.5, 181 R, 180 R, 33/1 B

[56] References Cited

U.S. PATENT DOCUMENTS

| | | | |
|---|---|---|---|
| 2,334,821 | 11/1943 | Hawley | 33/184.5 |
| 2,641,181 | 6/1953 | Leeberg | 33/184.5 |
| 2,711,691 | 6/1955 | Leavens | 101/216 |
| 2,994,964 | 8/1961 | Moffet | 33/184.5 |
| 3,323,454 | 6/1967 | McFarland | 33/184.5 |
| 3,520,253 | 7/1970 | Head | 33/184.5 |
| 3,573,138 | 3/1971 | Tobias | 33/184.5 |
| 4,019,434 | 4/1977 | Hoekter | 101/216 |
| 4,309,804 | 1/1982 | Sarka | 29/407 |

*Primary Examiner*—Willis Little
*Attorney, Agent, or Firm*—Alvin M. Esterlitz

[57] ABSTRACT

The present invention relates to a method, and means or device comprising an attachment, that is capable of quickly, efficiently, and accurately, horizontally aligning printing plates, especially offset printing plates on a rotary press such as an offset press, before the production run of the press. Set-up time is reduced to a minimum. The attachment may be removably affixed at a convenient location on the press in such a manner as to adjustably cooperate with the printing plate for horizontal alignment thereof, whereafter, the plate is locked in place, or hangs freely on the printing cylinder, and the printing job or run is started. Once the attachment or device guide is properly positioned, other or subsequent printing plates can be substituted for or changed with the first plate and quickly aligned, as the workload and variety of jobs for the day demands.

9 Claims, 8 Drawing Figures

FIG. 1
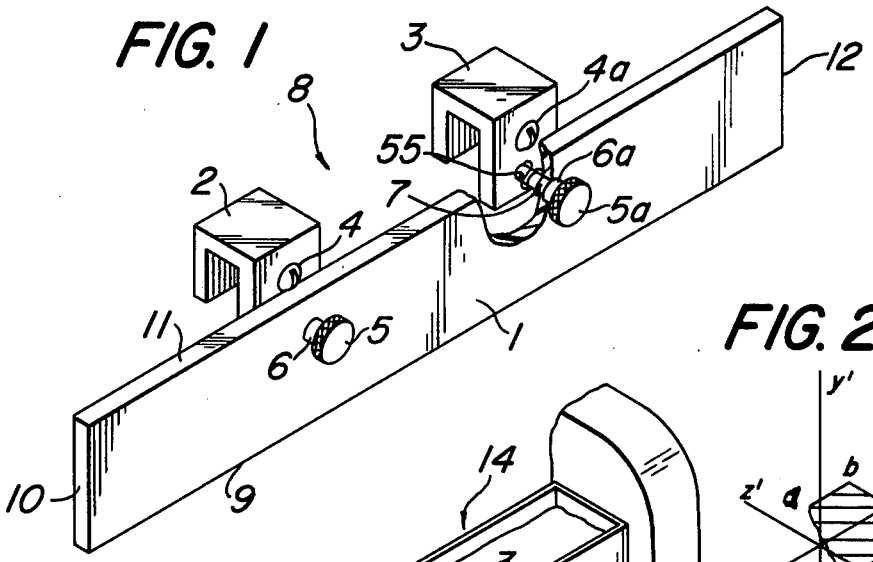
FIG. 2A
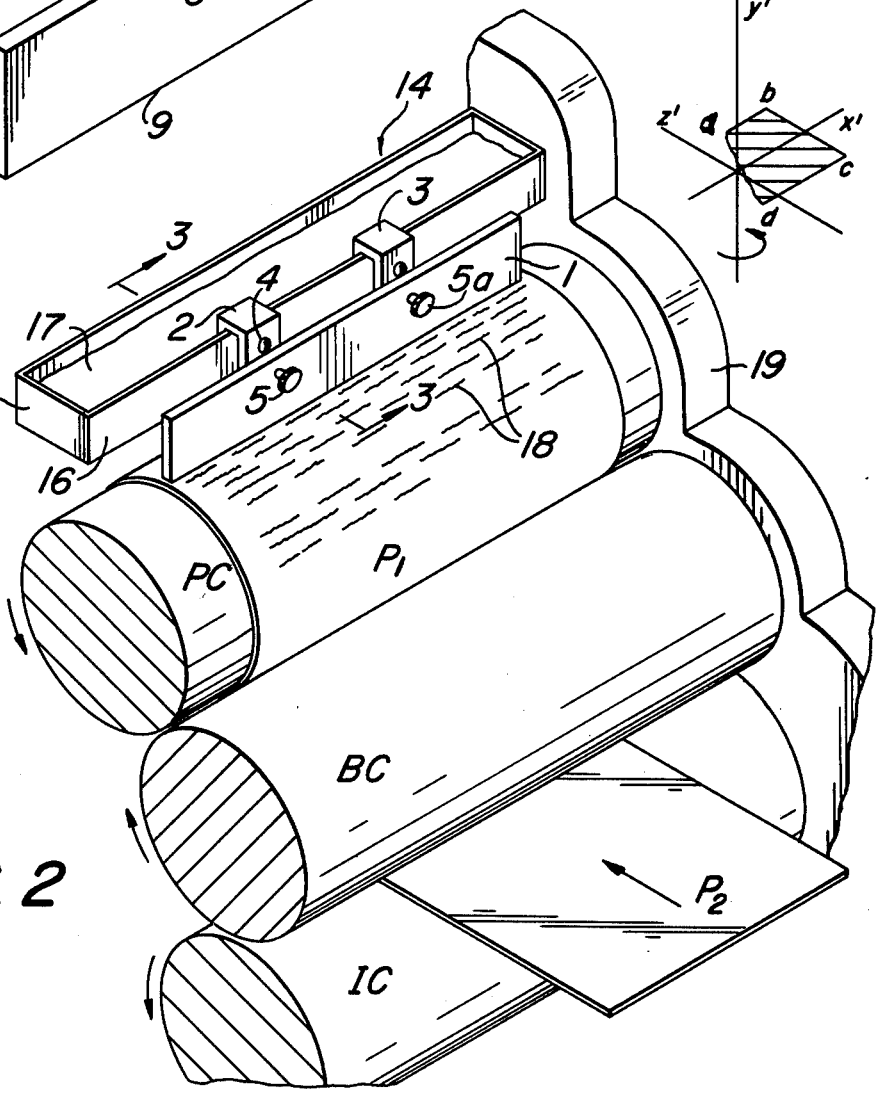
FIG. 2

OFFSET PRESS ATTACHMENT

BACKGROUND OF THE INVENTION

The present invention provides a method and means or device for quickly and accurately, horizontally aligning offset printing plates on the plate cylinder of an offset printing press.

The aligning operation as conventionally carried out is both time consuming and laborious, resulting in significant losses in press time and unnecessary labor expenses, all of which add to the cost and pricing of a printing job. Conventional methods and means inherently reduce the printers margin of profit, and shortcuts are often taken with resultant loss in printing quality.

Prior art aligning devices or means typically involve intensive (and usually permanent) modification of a press. Such means are characterized by their complexity and difficulty of use, whereas my invention is characterized by simplicity, accuracy and ease of use.

For example, U.S. Pat. No. 2,711,691, to W. B. Leavens, Jr. illustrates a prior art approach. It utilizes a complex supporting table, a transverse supporting means and microscopes or other expensive optical instruments to help spot and align the plate. While such means undoubtedly provided an advance in the art, it would appear to be somewhat cumbersome to use, as well as costly to provide and install. Also, it appears that such device lacks the speed and efficiency with which my device is adaptable to be used with a considerable number of printing plates during the course of a single day, or during the course of days that follow.

In small and medium size offset presses (and even with large presses) it is usually necessary before each and every run, which uses a separate or different printing plate, to swing the plate, clean the plate, and clean the blanket each and every time a "swing" or horizontal alignment adjustment is made, then run off a few copies of printed material, accurately measure the distance from the top of the printed sheet to a given line at the left and right hand margins of the printed sheet, and repeat the process until satisfactory horizontal alignment of the printing plate or master is obtained, as determined by the printed sheet on which the copy, i.e., lines, printed text, etc., are "square" or rectangular with reference to the edges of the sheet, especially the right and left edges of the sheet, i.e., wherein the lines, printed text, etc., form a 90° angle with these edges or an imaginary line parallel therewith. The entire process must then be repeated each and every time there is a plate change. Obviously, this is both cumbersome and frequently very time consuming. With my device and method, swinging of the plate and measuring of copy is only necessary for the first plate. The attachment device thereafter becomes a quick reference quide for accurate, horizontal alignment of subsequent plates, as will more fully be explained hereinafter by reference to the following drawings and figures and description which follows.

SUMMARY OF THE INVENTION

According to the present invention, comprising an attachment device and method, which will sometimes hereinafter be referred to more simply as a plate quide, (i.e., a printing plate quide or plate bar quide or just bar quide), it is first required, during the initial set up of the press, before attaching the plate guide, to select a printing plate that has horizontal rule lines of line copy or line text of several inches in length, preferably eight inches in length.

The printing plate is placed on the plate cylinder or plate roll of the offset press, in known manner, a few copies of printed material are run in the normal manner making sure the printed copy is "square" on the press sheet. This may involve swinging of the initial plate on the plate cylinder in known manner and measuring of the copy, with concomitant cleaning of the blanket and plate and intermittent stopping and starting of the press, until satisfactory horizontal aligned printed copy is obtained.

The plate guide attachment is then attached or affixed to the press, or some element thereof, in such a manner as to allow it to adjustably cooperate with the printing plate for horizontal alignment thereof. For illustrative purposes only, the plate guide may be attached to the front portion or surface of the water fountain or the solution fountain tray, normally positioned above the plate cylinder, by first tightening the top screws of one or more hangers which conveniently engage or clamp on to the front edge or face of the fountain tray, with a screwdriver or other similar implement. The right, rectangular, prism element, of the plate guide, is then held loosely to the hangers by adjusting thumb screws, such as thumb screws having tension mounted springs placed around the threaded portion of the thumb screw, enabling the rectangular prism element to move in and out, about a point of the prism which is the approximate center point of the length of the prism (or around an imaginary line running thru the center point of the length of the prism), or which point is substantially midway between the thumb screws or the hangers, by adjustment of the left and right hand thumb screws. The rectangular, prismatic element is preferably an opaque, and more preferably a white or off-white opaque material, having flat and smooth surfaces and edges at 90 degree angles, with the front and bottom surfaces being dull or having a matte finish. The prism is so arranged that its horizontal, flat bottom surface is located or spatially positioned above the top of the printing plate cylinder (or plate cylinder having a printing plate attached thereto) along a line substantially or approximately transverse and horizontal to the top of the plate cylinder or along a line transverse and horizontal with reference to the plate cylinder wherein said transverse line is a little below the top of the cylinder plate; of course the prismatic element is above the plate cylinder so that it does not touch it; and by moving the thumb adjusting screws in or out, the prism moves (more particularly the bottom surface of the prism moves) in a plane parallel with an imaginary plane horizontally running through the transverse line, above-mentioned.

The tail edge of the printing plate, such as in the case of a flexible metal printing plate, is then loosened so that the bottom edge of the plate or master is free to be raised or moved. The flexible plate is then raised and held outwardly by holding its bottom edge tautly and the plate is brought upwards into a position with its opposite edge (opposite the bottom edge or the edge being held) flush with the bottom surface and edge of the rectangular prism. The plate, or a portion thereof, is then also substantially perpendicular to the front face of the prism element. At this time, preferably the longest line of copy or image on the printing plate is aligned with the edge formed by the prism's bottom surface and front face by adjusting the two thumb screws (which are usually placed below or lower than the tightening screws of the hangers) of the plate guide, more specifically the rectangular prism element thereof is adjusted to be substantially even with the line of copy or image on the first plate (some operators may find a horizontal rule line easier or faster to line up for more precise accuracy).

The above procedure only needs to be repeated if the setting of the plate guide has been disturbed by use on another press or if the adjusting thumb screws have been accidently turned. Since the plate guide is removably affixed to the press or water fountain thereof, it may, if desired be removed by loosening the top screws of the hangers only, thereby permitting the fountain to be removed and cleaned and the plate guide if necessary.

In using the plate guide or attachment for attaching subsequent printing plates, the plate is first attached to the top gripper clamp only. The offset or other plate is then held outwardly and tautly and perpindicular to the prism element of the plate guide. Then the offset plate is gently brought up against the bottom edge of the prism element of the plate guide to see if baseline copy (or other copy if desired) is even with the bottom edge. If the baseline or other copy is not even with the bottom edge of the plate guide, the usual press adjustment, in a known manner, is made by swinging* or shifting the offset plate until copy is exactly even with the bottom edge of the prism element of the plate guide. (It is important not to move any of the thumb adjusting screws during this procedure.) The tail end of the plate, for example in the case of a metal plate is then attached to the plate cylinder and the press is then run.

Plate swinging or plate cocking, as it is sometimes called are terms well known in the art, for example see pages 12:44, 12:45, 12:16 and 12:17 of "The Lithographers Manual", edited by Charles Shapiro and published by The Graphic Arts Technical Foundation, Inc., Pittsburgh, Pa. 5th Edition, copyright 1974. As indicated in said manual, practically all plate cylinders of practically all offset presses have vernier adJustment means for sidewise shifting as well as for "cocking", "swinging" or "twisting" of the plate. Typical of such presses are models 350/360 offset printing equipment with which much of the basic work (especially the 360 model) of this invention was done—the models referred to are made by A. B. Dick Company of Chicago, Ill. Reference is also made to the Operating Instructions booklet for models 350/360 A. B. Dick offset equipment, copyright 1968: the Operating Instructions, as well as references cited above of "The Lithographers Manual" are incorporated herein by reference.

BRIEF DESCRIPTION OF THE DRAWINGS

The above and other features of the present invention will become more apparent to those skilled in the art to which it pertains upon reading the following description (as well as the abstract, background and summary hereinbefore given) of the invention and its preferred embodiments when taken together with the accompanying drawings in which:

FIG. 1 is an isometric view, partly broken away, of my offset press attachment or plate guide for achieving horizontal alignment of printing plates or masters on the press;

FIG. 2 is a pictorial, isometric, partial view of a typical offset printing press showing the plate guide attachment in one possible position on the press above the plate cylinder of the press, said plate cylinder having affixed thereto a flexible printing plate or master with images thereon and in horizontal alignment with the leading edge formed by the intersection of the front face and bottom surface of the prism element of the attachment;

FIG. 2A is an analytical, geometrical representation of an imaginary plane, a, b, c, d, which is a continuation of the plane on which the bottom surface of the plate guide is resting or set (more particularly, the bottom surface of the rectangular, prismatic element of the plate guide attachment), partly broken away, said, plane passing through the x', z' axes of the x', y', z' diagram, the diagram also having a curved arrow near the bottom of y' axis, indicating how the prismatic element of the attachment could be twisted or turned about the y' axis in the plane a, b, c, d, y' being a line parallel to a similar imaginary line y approximately midway between the hangers, to bring the attachment into horizontal alignment with line copy or other image on the plate in the first instance; of course the plane a, b, c, d could also be a little or somewhat below the top center transverse line of the plate cyliner;

Figure 3:
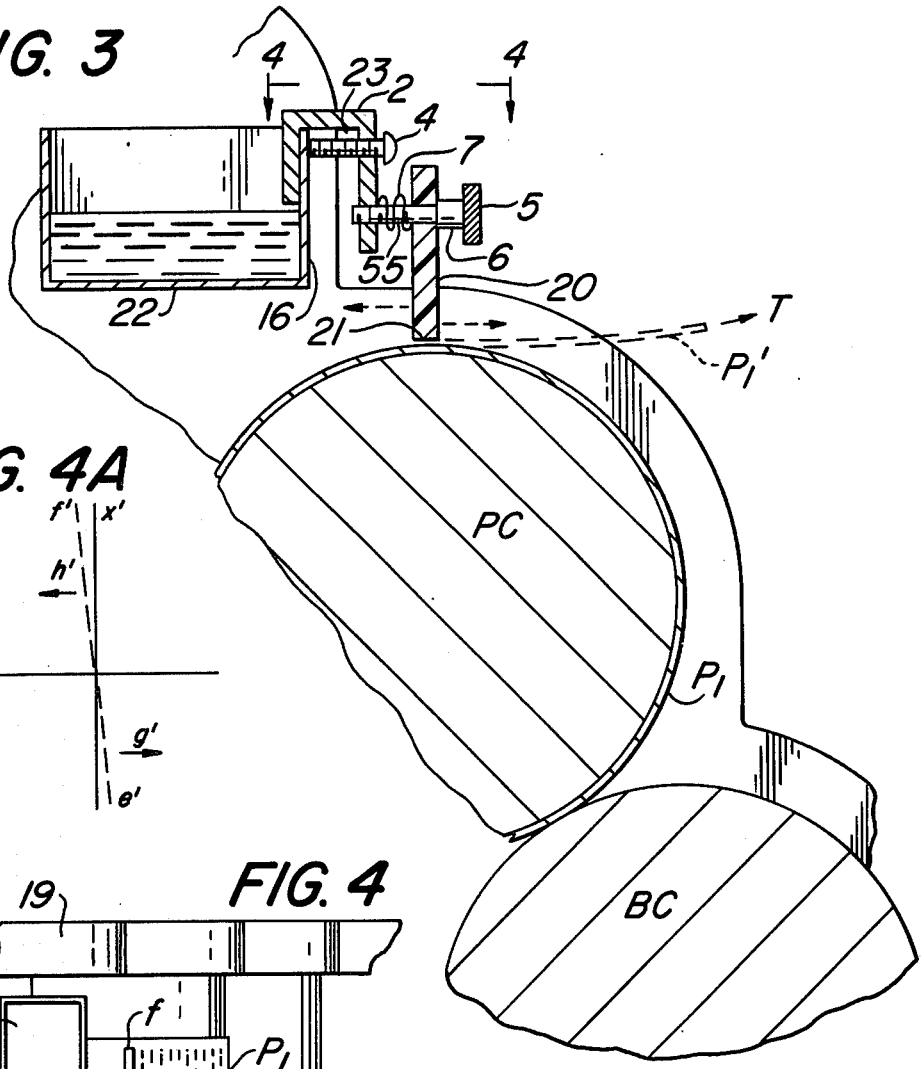
FIG. 3 is a partial vertical, sectional view, of the press and attachment, taken on line 3—3 of FIG. 2 and viewed in the direction of the arrows 3—3.

A and B are schematic showings of printing plates A and B having images thereon shown by wavy lines.

DESCRIPTION OF PREFERRED EMBODIMENTS OF THE INVENTION

The invention presented so far has been described primarily as an attachment for horizontal alignment of printing plates on an offset printing press which is indeed the preferred embodiment; however, it is to be understood that the invention is generally applicable to any rotary press which uses a plate or master having images thereon, and which requires horizontal alignment.

As is well known, in offset lithography or printing, the inked images are not transferred, on the press, directly from the printing plate or master to the paper to be printed. The images are first "offset" (transferred) to a rubber (or other elastic material)—covered cylinder, generally referred to as the blanket cylinder, which then offsets them to the paper being printed. Printing plates, or masters with ink (grease) receptive areas comprising the images and non-ink water-receptive areas for the non-image areas, can be made of various materials, such as paper, plastic, metal, etc.; Printing plates are typically the full size or somewhat smaller than the size of the press cylinder, and must be thin and flexible enough to be wrapped relatively snugly around the master cylinder. The thickness of representative plates will usually vary from a few thousandths of an inch up to about 0.025. The plates are commonly made by a photographic or more particularly a photomechanical and/or photochemical process, well known in the art, to produce the ink receptive image. Alternatively, and in earlier times, the ink receptive image was and/or is placed on the plate or master by means of typewriter, carbon paper, pencil, crayon. In the usual practice, the master is placed on the plate cylinder, dampened or moistened and then inked. The moistening agents are repelled by the ink receptive image but are accepted by the non-image area of the master. The ink adheres only to the ink receptive image and is repelled from the moistened non-image area of the master or printing plate.

My invention is applicable to virtually all flexible printing plates or masters, no matter how made, or of what type (surface, deep etch, etc.) or of what material. In other words, my invention is not dependent in any way on the specific nature of the plate, the material of which it is made, or the process by which it is made.

The platemaking process involves to some extent an inherent problem with respect to correct, horizontal, alignment of the images on the plate, and necessarily the finished printed copy made with the plate. Considering, for example, a plate having line copy or images thereon, if the plate is made as a perfect copy of item to be printed (be it artwork, text, forms, etc.) and if it is assembled on the press correctly, the printed final copies would be expected to be "square" on the paper on which it is printed (an assumption is made that the paper stock being used is "square" itself, that is, for example, an 8½"x 11" paper would be that size with each corner a true 90 degree, or form an exact right angle at each corner, and that the paper is fed and aligned correctly). The problem is that most printing plates which are produced, the platemaking being one of the more expensive and critical parts of the printing process, do not always have the images perfectly "square" thereon. It is precisely that problem which my invention is intended to correct (but on the press, not in the platemaking process itself). For example, consider the following schematic showings of two printing plates, A and B, shown on the drawings with images shown in wavy lines on each. The "A" plate has copy which is "square" and would print square, with little or no horizontal adjustment required when the plate is placed on the plate cylinder. However, plate "B" (and it is understood that the left to right downward slant of the images is clearly exaggerated for illustration purposes) would have to be, by trial and error, horizontally adjusted or aligned (with the adjustment knobs present in known manner of virtually all offset or rotary presses) until satisfactory printed copy is obtained and then the press could be run. This "swinging" of the printing plate on the plate cylinder of the press by the operator is one of the most frustrating parts of a printing job. It is usually done by "eye" by the operator until alignment is accomplished. However, with my invention, once the plate guide attachment is properly positioned and set by use of a first plate, subsequent plates can be quickly brought into horizontal alignment before the press run, by simply swinging the plate, for example, plate B until the baseline or other line of copy image is even with the bottom front edge of the rectangular, right, prismatic element of my plate guide attachment. The bottom front edge of my plate guide forms a true reference line which can be used over and over again with each new plate as it is placed on the press.

With further reference to the drawings, the plate guide attachment 8, is shown on FIG. 1 as having a left hand hanger 2 and a right hand hanger 3, said hangers being placed over in a clamp-like fashion over the front face 16 of a water or solution fountain 14 on the press. The hangers are tightened against the fountain by tightening the machine screws 4 and 4*a*, shown in FIGS. 1, 2, and 3. The hangers support or carry in a hanging or suspending, longitudinally spaced manner, a rectangular, right, prismatic element 1, which is movable towards or away from the hangers by the adjusting thumb screws 5 and 5*a*. The adjusting thumb screws have shoulders or collars 6 and 6*a* and have tension mounted springs 7 between each hanger and the rear surface of the prism, as shown clearly in FIGS. 1 and 3; each adjusting thumb screw has a threaded or screw portion 55 which extends into each hanger 5 or 5*a* beneath the metal tightening screws as shown in FIGS. 1 and 3. The prismatic element 1 is preferably a carefully machined piece, which optically speaking is preferably white or off-white opaque, has a top 11 and bottom 9 flat smooth surface, a front and back smooth surface, and end surfaces 10 and 12. These surfaces form 90 degree angles at the edges as in a regular, right, rectangular, solid prism. FIG. 2 is a representation of a typical offset printing press wherein PC is the plate cylinder, having a printing plate or master $P_1$, wrapped around it, with wavy, broken, lines 18 representing images, line copy, text or the like, and wherein BC is the blanket cylinder, IC is the impression cylinder and P2 is the paper which is being printed and fed to the press in the direction of the long, straight arrow. The spatial relationship of the bottom surface of the prismatic element 1 to the plate cylinder PC to the plate cylinder of the press (or with printing plate attached thereto) is such that it is in a plane parallel to or with (and tangential) an imaginary substantially horizontal plane transversing or running thru a line (or imaginary line) at the top of the curvature of the plate cylinder, or somewhat below said line, said line running from the left hand edge to the right hand edge of the plate cylinder, when viewed, for example, from the front of the press.

The hangers 2 and 3, the tightening screws and adjustable thumb screws are preferably positioned symmetrically along the length of the prismatic element of the plate guide, as shown in FIG. 2, that is the left hand hanger and adjusting thumb screw is located approximately ⅓ the distance in from the left hand edge, right hand hanger, screws, etc., ⅓ in from the right hand edge of the prismatic element. However, this need not be the case for my device to function properly. The hangers and adjusting thumb screws can be placed off center of the prismatic element, either left or right and affixed to a similar off center positon of the water fountain or other convenient part of the press, provided the hangers are not placed too close together or side by side. In other words, enough distance should be available between the hangers to allow the prismatic element of the plate guide to swing in and out or twist about a point, in or through a plane, as mentioned above, approximately midway between the hangers.

Figure 4A:
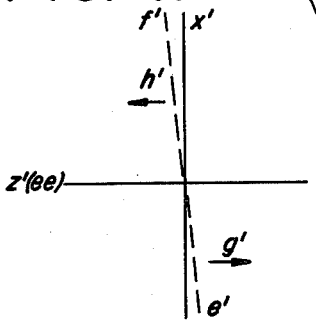
FIG. 4A is a graphical representation, of a part of a similar plan view, taken on line 4—4 of FIG. 3, in reduced substantially proportional dimension, showing the right hand edge, and of course also the left hand edge of the prism element, when it is set in twisted or turned position about the y' axis, and the z' axis in the x', z' plane (or a, b, c, d plane which passes thru x', z', where z is an imaginary line parallel to z' of FIG. 2A and where z is substantially midway between the hangers or thumb screws shown thereon; and the twisting or turning of the prism element is accomplished by, for example, tightening the right hand adjusting thumb screw and lossening the left hand thumb adjusting screw so that the right hand edge of the prismatic element moves backwards (or counter clockwise about the approximate center point between the hangers and/or thumb screws) and the left hand edge of the prismatic element moves forward and also counter clockwise about the approximate center point between the hangers and/or thumb screws.
Figure 4:
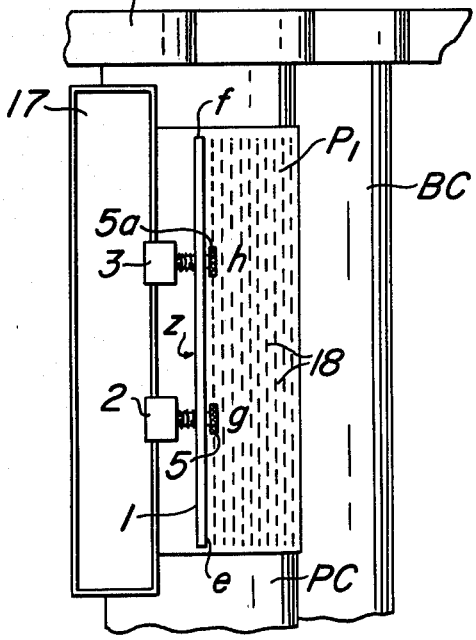
FIG. 4 is a partial, plan view of the attachment and press taken on line 4—4 of FIG. 3.
Figure 4:
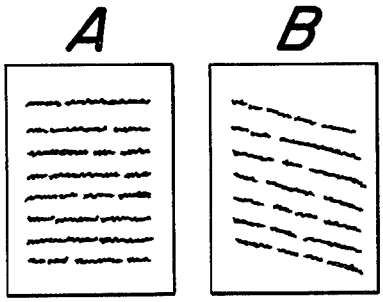

FIG. 3 shows a cross section along lines 3—3 with the prismatic element's front surface 20, and bottom surface 21. The prism moves rearward or forward, by adjusting the thumb screws, as shown by the dotted arrows. FIG. 3 also shows, the printing plate Pl being held outwardly, under tension T, in dotted lines, indicated as P1′ (P1 prime) during the lining up of copy or images 18 (see FIG. 4) even with the edge of the prism when subsequent plates are placed and aligned on the plate PC, or during the initial set-up procedure or installation of the plate guide. FIG. 4 shows the prism having points e, g, h, and f, first in correct position with a perfectly "square" plate P1, but then in cocked or twisted position (e′, f′, g′, h′) assuming the initial plate did not have correctly "square" images, in FIG. 4A. Element 16 is the inside face of the water fountain, 22 the bottom thereof, and 17 is the well or fountain trough; 19 is a portion of the housing for the press. Element 23 is the threaded portion of the metal screw.

A further word need be mentioned about the optical and material properties of the prismatic element of the plate guide. It is desireable that the bottom surface and the front surface (and also the side surfaces) of the prism have dull or matte finish and that it should be opaque or at least somewhat translucent. Preferably, the prism is made of a white or off-white opaque metallic or plastic material such as any readily available, dimensionally stable, relatively stiff plastic, over the temperature range normally encountered in a printing shop, i.e. approximately 60 degrees to 90 degrees F., such as an acrylic plastic (polymethylmethacrylate), nylon rigid or semi-rigid vinyl, etc. For this purpose, ¼″ plastic sheet is quite satisfactory. The hangers can be metal or plastic, but a lightweight strong metal such as aluminum or stainless steel is preferred. The reason that the front, bottom, and preferably edge surfaces of the rectangular, prism element, are dull and or matte and thus relatively non-reflective of light, is to provide a contrast with the printing plate and images thereon; under these circumstances it is easy to see the line of copy or images on the printing plate when it is brought into contact with the guide during the aligning and/or set-up procedure.

While there has been shown and described a preferred embodiment of my plate guide invention or attachment, it will be appreciated that many changes and modifications can be made by those skilled in the art without, however, departing from the essential spirit thereof.

I claim:

1. A method of accurately, horizontally aligning flexible printing plates on a rotary press having a rotatable cylindrical plate member and a first printing plate or master with images thereon, said printing plate being wrapped around the plate cylinder, the first printing plate or master being correctly, horizontally aligned, which comprises attaching a removable plate guide to means on the press located above the plate cylinder, said plate guide having a movable rectangular prismatic element with its longest dimension running transverse to the plate cylinder and thereabove, adjusting one or more spring tensioned means and thereby allowing the prismatic element to move and twist essentially about its center point until the primary edge formed by the front face and bottom surface of said prismatic element is aligned with a line of images on the plate or master when it is held outwardly, under tension, and at least a portion of said plate or master is flush with the bottom surface of the prismatic element, then replacing the first printing plate or master with a second printing plate or master not in correct horizontal alignment, and then moving the second plate clockwise or counterclockwise on the plate cylinder until a line of images on the second plate or master is even with the primary edge of said prismatic element.

2. Method according to claim 1 wherein the bottom surface of the longest dimension of the prismatic element runs above but along a line transverse and a little below the top transverse line of the plate cylinder.

3. Method according to claim 2, in which the rotary press is an offset printing press.

4. Method according to claim 3, wherein the flexible printing plate is a metal plate, the tail end of which is clamped in place after it is in alignment with said prismatic element.

5. Method according to claim 4, wherein the means above the press to which the plate guide is attached is a water fountain.

6. Method according to claim 5, wherein the plate guide is first tightened against and clamped onto the front face of the fountain by tightening screws on hangers to the fountain, the hangers supporting the prismatic element which is suspended in front of and below the hangers, and wherein the spring tensioned means are two adjustable thumb screws, the screw portion of which passes through the prismatic element into the hangers, said hangers being substantially symmetrically displaced along the length of the fountain and the prismatic element.

7. A printing plate guide removable rotary press attachment comprising a pair of hangers for clamping and affixing to said rotary press at a location above the plate cylinder of the rotary press, said hangers having suspended therefrom a rectangular, prismatic element with adjustable means for moving said prismatic element in a turning or twisting fashion around the hangers whereby printing plates can be horizontally aligned.

8. A printing plate guide according to claim 7 wherein the adjustable means are adjustable thumb screws having tension springs mounted thereon.

9. A printing plate guide according to claim 8 wherein the rectangular prism element has a front and bottom smooth surfaces which are dull or matte in finish.

* * * * *